United States Patent [19]

Payer et al.

[11] Patent Number: 4,860,368

[45] Date of Patent: Aug. 22, 1989

[54] ACOUSTIC TRANSDUCERS WITH IMPROVED FREQUENCY RESPONSE

[75] Inventors: Ernst Payer, Puchheim; Hans Schierl, Steinhoering, both of Fed. Rep. of Germany

[73] Assignee: Siemens Aktiengesellschaft, Berlin and Munich, Fed. Rep. of Germany

[21] Appl. No.: 87,324

[22] Filed: Aug. 20, 1987

[30] Foreign Application Priority Data

Sep. 11, 1986 [DE] Fed. Rep. of Germany ..... 3630951

[51] Int. Cl.[4] ..... H04R 1/28; H04R 17/00

[52] U.S. Cl. ..... 381/159; 381/205; 381/188

[58] Field of Search ..... 181/160, 182; 381/114, 381/153, 155, 159, 168, 169, 173, 205, 190, 191, 188; 307/400

[56] References Cited

U.S. PATENT DOCUMENTS 4,240,002 12/1980 Tosi et al. ..... 381/205
4,268,725 5/1981 Nakagawa et al. ..... 381/191
4,376,232 3/1983 Martin ..... 181/160
4,637,489 1/1987 Iwanaka et al. ..... 181/160

FOREIGN PATENT DOCUMENTS 538166 2/1982 Australia .
1167897 11/1964 Fed. Rep. of Germany .
3107293 9/1982 Fed. Rep. of Germany .
950675 2/1964 United Kingdom .

*Primary Examiner*—David K. Moore
*Assistant Examiner*—Alvin Oberley
*Attorney, Agent, or Firm*—Hill, Van Santen, Steadman & Simpson

[57] ABSTRACT

An acoustic transducer has two partially annular resonators arranged in an ante-chamber of a transducer plate, the resonators being formed by annular channels which are provided in an upper housing component which are sealed from the exterior by a covering plate. The channels are linked to the ante-chamber of the transducer plate through openings.

5 Claims, 1 Drawing Sheet

ACOUSTIC TRANSDUCERS WITH IMPROVED FREQUENCY RESPONSE

BACKGROUND OF THE INVENTION

1. Field of the Invention

The present invention relates generally to an arrangement for improving the frequency response of acoustic transducers, such as in telephones.

2. Description of the Related Art

It is known to arrange resonators in an ante-chamber of a transducer plate in an acoustic transducer. For instance, in German Patent No. 1167897, it is disclosed to arrange a resonator in front of a transducer membrane in an acoustic whistle with a circular longitudinal axis. The resonator is arranged as a whistle on the transducer membrane itself. This generally necessitates an elaborate construction for the transducer membrane which prevents its use in other applications.

In German Patent No. OS 31 07 293, an arrangement is disclosed in which resonators are formed between a separating plate arranged in front of a transducer plate and a mounting which seals the separating plate. The separating plate is provided with differing chambers on which are arranged projections which contact the mounting when the capsale is assembled. The cavities thus produced form the resonators which are connected through coupling openings to an ante-chamber which preceeds the transducer plate. A design of this type requires some degree of enlargement of the structural height of the overall capsule in order to form the resonators, which frequently leads to difficulties or the need to reconstruct the handset in which they are accommodated. Furthermore, the size of the chamfers and the sealing of the resonator chambers give rise to difficulties during production.

SUMMARY OF THE INVENTION

An object of the present invention is to provide an improved frequency response in an acoustic transducer such as for use in a telephone, the transducer having resonators arranged in front of a transducer plate without increasing the overall structural height of the transducer capsule or unit.

This and other objects are achieved in accordance with the present invention by providing an acoustic transducer having a transducer plate which is clamped in bearing components between a lower housing component and upper housing component and which is provided with a piezoelectric coating. The upper housing component has a central opening through which sound is transmitted. The upper housing component is provided with two further openings which represent coupling openings and are coupled to the ante-chamber of the transducer plate. The two further openings are connected to annular channels which are open at one side and are provided in the upper housing component. The openings and the channels are commonly closed from the exterior of the upper housing component by a covering plate which has a central opening.

The resonators of the present acoustic transducer are formed by the channels being sealed by the cover and by the openings to the ante-chamber of the transducer plate. By providing these elements in the upper housing component, there is no change in the overall structural height of the transducer unit. The individual components, with the exception of the transducer plate, are relatively simple molded components of synthetic material. The dimensions of the molded components are such that they give rise to no difficulties in manufacturing. Furthermore, no change occurs in the resonators when the channels are closed so that the projections provided in the seperating plate of the arrangement shown in German Patent No. OS 31 07 293 can be dispensed with.

To form different resonators, it is expedient for the channels to have either the same or different cross sections and lengths. To exactly position the cover plate, it is advantageous that the covering plate be provided with a hollow cylindrical projection extending adjacent to and around the central opening, the cylindrical projection engaging into the central opening of the upper housing component. The covering plate is, thus, firmly fixed in position.

In one embodiment, the cover plate is bonded to the upper housing component. However, from the standpoint of ease of assembly, the cylindrical projection is provided, in another embodiment, with molded engaging lugs which engage behind an annular cutout in the upper housing component.

To ensure an absolutely tight seal for the channels and the openings, it is expedient for the angle between the surface of the covering plate and the axis of the cylindrical projection to be somewhat less than 90 degrees, so that the edge of the covering plate contacts the housing surface under a bias.

DESCRIPTION OF THE PREFERRED EMBODIMENTS

Figure 1:
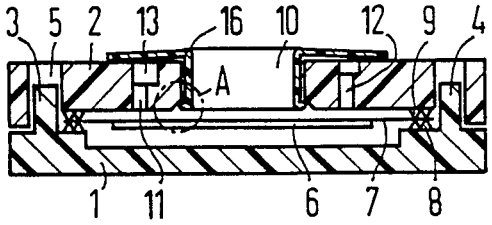
FIG. 1 is a vertical cross section through a transducer capsule or unit according to the principles of the present invention.

A transducer unit or capsule consists of a lower housing component 1 and an upper housing component 2 which closes off the lower component 1. Cylindrical pins 3 and 4 fasten the two components by extending from edge regions of the lower component 1 and engaging into corresponding recesses 5 in the upper housing component 2. Between the upper housing component 2 and the lower housing component 1 is a transducer plate 7 which is provided with a piezoelectric layer 6. The edges of the transducer plate 7 are clamped between bearing elements 8 and 9, which are shown as annular ridges on each of the upper and lower housing components 1 and 2 engaging the transducer plate 7.

Figure 4:
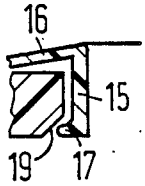
FIG. 4 is a fragmentary cross section showing a detail from FIG. 1.
Figure 2:
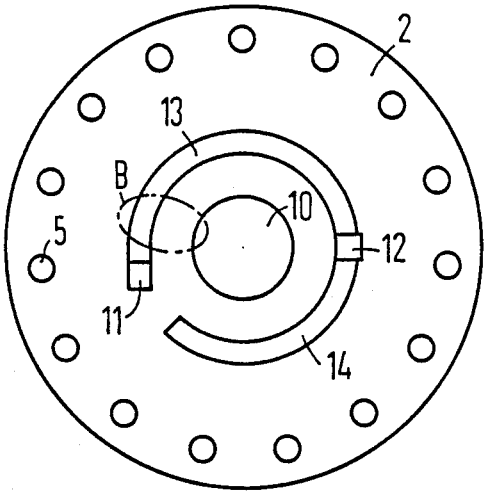
FIG. 2 is a plan view of the transducer capsule from FIG. 1 shown with the covering plate removed.
Figure 5:
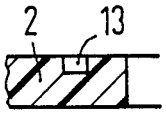
FIG. 5 is a fragmentary cross section generally at area B of FIG. 2 showing details thereof.
Figure 3:
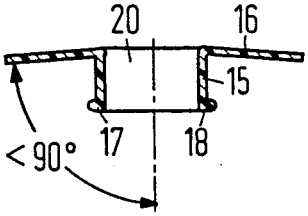
FIG. 3 is a vertical cross section through the covering plate.

The upper housing component 2 includes a central opening 10 through which sound is transmitted. Two further openings 11 and 12 are also provided in the upper housing component 2, the further openings 11 and 12 being adjoined by two channels 13 and 14 which are open at one side, as can be seen in FIGS. 2 and 5. The openings 11 and 12 and the channels 13 and 14 are commonly closed by a covering plate 16 which is provided with a cylindrical projection 15, as shown in FIG. 3. The projection 15 has at its free end a plurality of engaging lugs 17 and 18 shown in FIG. 4, which engage behind a camfer, or annular recess, 19 in the upper housing component 2 in the area of the central opening.

The angle between the surface of the covering plate 16 and the axis of the cylindrical projection 15 is less than 90 degrees. When the covering plate is placed over the channels 13 and 14 and over the openings 11 and 12, the covering plate 16 engages the upper housing component 2. In particular, edge regions of the covering plate 16 firmly contact the surface of the upper housing component 2 under bias so that the channels 13 and 14 and in the openings 11 and 12 are acousticaly tightly sealed.

The channels 13 and 14 each have a partially annular shape. Once closed by the cover plate 16, each of the channels 13 and 14 form resonant chambers, sound being transmitted to the resonant chamber through the openings 11 and 12. It is, of course, possible to vary the size, shape and number of openings and channels to achieve different resonance effects and different frequency response characteristics of the transducer. The resonance chambers are thereby provided with many added parts, without significantly increasing the size of the transducer, and without elaborate and complex manufacturing and assembly.

Thus, there is provided a transducer for use in a telephone handset or the like with improved frequency response and with a relatively small height for the transducer unit.

Although other modifications and changes may be suggested by those skilled in the art, it is the intention of the inventors to embody within the patent warranted hereon all changes and modifications as reasonably and properly come within the scope of their contribution to the art.

I claim:

1. An improved acoustic transducer having a transducer plate coated with a piezoelectric coating and clamped between upper and lower housing components, said upper housing component having a central sound transmitting opening, the improvement comprising:

said upper housing component defining at least two further openings being coupled openings extending to an antechamber above said transducer plate, said upper housing component further defining generally annular channels open at one side and provided connected to said upper housing component, a covering plate having a central opening and commonly closing said coupling openings and said channels from an exterior of said upper housing, said covering plate having a cylindrical projection adjoining said central opening of said covering plate, said cylindrical projection engaged into said central sound transmitting opening of said upper housing component.

2. An improved acoustic transducer as claimed in claim 1, wherein said cylindrical projection includes engaging lugs engaged behind a portion of said upper housing component.

3. An improved acoustic transducer as claimed in claim 1, wherein said cylindrical projection defines an angle with a surface of said covering plate of less than 90 degrees.

4. An acoustic transducer comprising:

a lower housing component having a lower gripping section; an upper housing component fastened to said lower housing component and having upper gripping section disposed opposite said lower gripping section;

a piezoelectric transducer plate held between said upper and lower gripping sections of said upper and lower housing components;

said upper housing component defining a sound transmitting opening and a channel formed into a side of said upper housing component opposite said transducer plate, said upper housing component having at least one upper housing component and into said channel;

a cover plate fastened over said channel to define resonant chamber, said cover plate including:

a hollow cylindrical portion extending into said sound transmitting opening in said upper housing component, and an annular flange extending from said cylindrical portion, said annular flange extending over said channel and said at least one further opening in said upper housing component, said annular flange having an outer edge in contact with said upper housing component to close off said channel to the outside and form a resonant chamber.

5. An acoustic transducer as claimed in claim 4, wherein said annular flange is biased against said upper housing component.

* * * * *